United States Patent [19]

Hasegawa

[11] 4,454,852

[45] Jun. 19, 1984

[54] ELECTRONIC FUEL INJECTION CONTROL SYSTEM FOR INTERNAL COMBUSTION ENGINES HAVING EXHAUST GAS RECIRCULATION CONTROL DEVICES

[75] Inventor: Shumpei Hasegawa, Niiza, Japan

[73] Assignee: Honda Motor Co., Ltd., Tokyo, Japan

[21] Appl. No.: 442,097

[22] Filed: Nov. 16, 1982

[30] Foreign Application Priority Data

Nov. 19, 1981 [JP] Japan ..... 56-185765

[51] Int. Cl.[3] ..... F02M 25/06; F02B 3/08; F02D 17/00

[52] U.S. Cl. ..... 123/568; 123/571; 123/489; 123/480; 123/491; 364/431.06; 364/431.04

[58] Field of Search ..... 123/568, 571, 489, 480, 123/491; 364/431.06, 431.04

[56] References Cited

U.S. PATENT DOCUMENTS

| | | | |
|---|---|---|---|
| 4,165,722 | 8/1979 | Aoyama | 123/571 |
| 4,181,944 | 1/1980 | Yamauchi et al. | 123/571 |
| 4,347,570 | 8/1982 | Akiyama et al. | 123/571 |
| 4,369,752 | 1/1983 | Ito et al. | 123/568 |
| 4,375,800 | 3/1983 | Otsuka et al. | 123/571 |
| 4,380,988 | 4/1983 | Otsuka et al. | 123/571 |
| 4,388,909 | 6/1983 | Ogasawara et al. | 123/571 X |
| 4,399,791 | 8/1983 | Kobayashi et al. | 123/571 X |
| 4,399,799 | 8/1983 | Romblom et al. | 123/571 |
| 4,409,948 | 10/1983 | Hasegawa et al. | 123/571 |

FOREIGN PATENT DOCUMENTS

| | | | |
|---|---|---|---|
| 54-17421 | 2/1979 | Japan | 123/571 |
| 54-20203 | 2/1979 | Japan | 123/571 |
| 54-38438 | 3/1979 | Japan | 123/571 |
| 2006988 | 5/1979 | United Kingdom | 123/571 |

*Primary Examiner*—Wendell E. Burns
*Attorney, Agent, or Firm*—Arthur L. Lessler

[57] ABSTRACT

An electronic fuel injection control system for an internal combustion engine, includes means for maintaining the recirculating quantity of exhaust gases at a constant ratio with respect to the total intake air quantity, irrespective of changes in the ambient atmospheric pressure, and means for correcting the injection period for fuel being supplied to the engine by the use of a correction coefficient determined as a function of atmospheric absolute pressure and intake pipe absolute pressure, whereby the air/fuel ratio of the mixture is maintained at an optimum value against changes in the atmospheric pressure, even when exhaust gas recirculation is effected.

3 Claims, 13 Drawing Figures

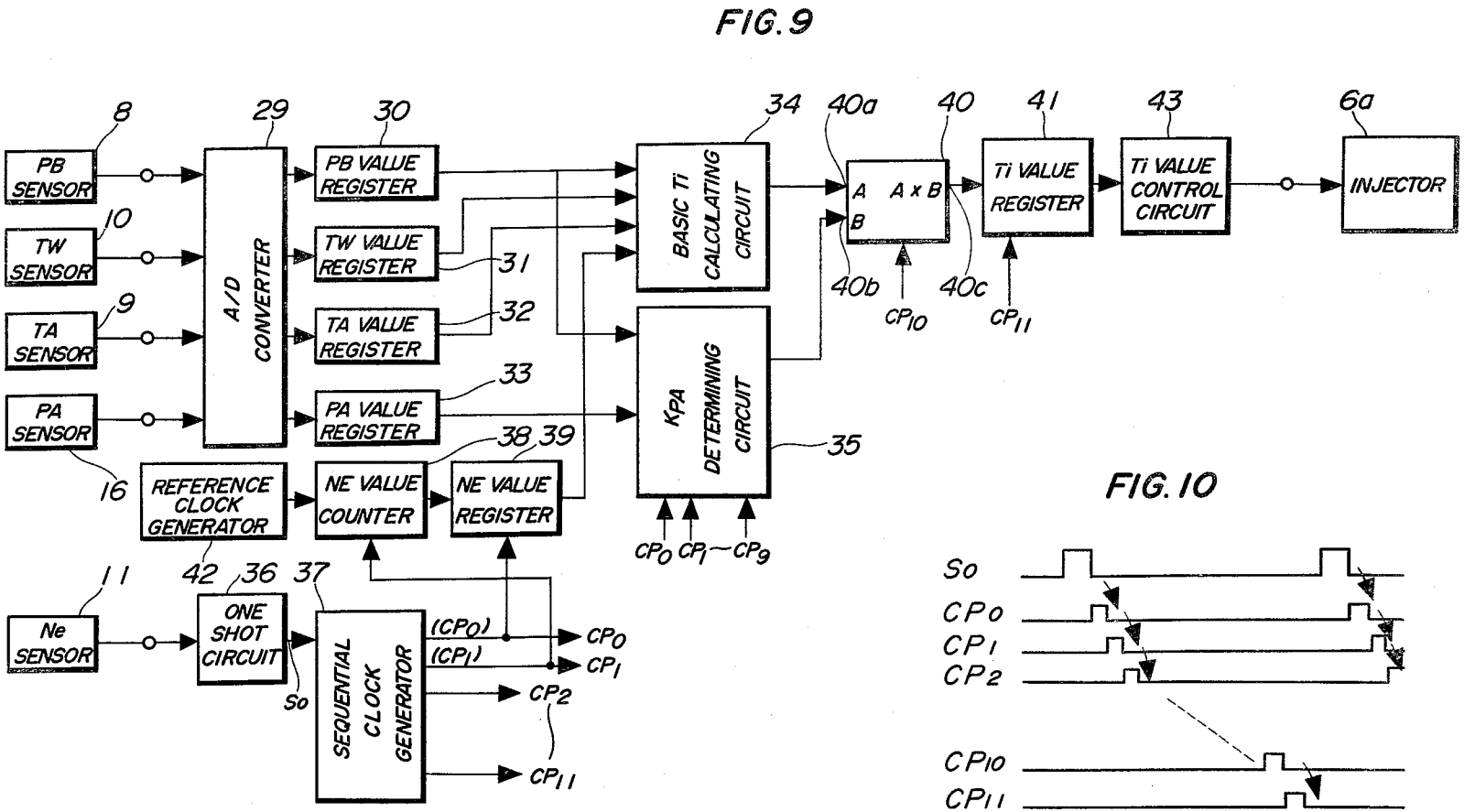
FIG. 9
INJECTOR
6a
Ti VALUE CONTROL CIRCUIT
43
Ti VALUE REGISTER
41
CP11
A x B
A
B
40
40c
CP10
40a
40b
BASIC Ti CALCULATING CIRCUIT
34
KPA DETERMINING CIRCUIT
35
CP0 CP1 ~ CP9
PB VALUE REGISTER
30
TW VALUE REGISTER
31
TA VALUE REGISTER
32
PA VALUE REGISTER
33
NE VALUE REGISTER
38 39
NE VALUE COUNTER
SEQUENTIAL CLOCK GENERATOR
37
(CP0)
(CP1)
CP0
CP1
CP2
CP11
A/D CONVERTER
29
REFERENCE CLOCK GENERATOR
42
ONE SHOT CIRCUIT
36
So
PB SENSOR
8
TW SENSOR
10
TA SENSOR
9
PA SENSOR
16
Ne SENSOR
11

FIG. 10
So
CP0
CP1
CP2
CP10
CP11

| PA \ PB | PB9 | PB10 | ----- | PBj | ----- | PB16 |
|---|---|---|---|---|---|---|
| PA1 | KPA1·9 | KPA1·10 | | | | |
| PA2 | KPA2·9 | KPA2·10 | | | | |
| ⋮ | | | | | | |
| PAi | | | | KPAij | | |
| ⋮ | | | | | | |
| PA8 | | | | | | KPA8·16 |

ELECTRONIC FUEL INJECTION CONTROL SYSTEM FOR INTERNAL COMBUSTION ENGINES HAVING EXHAUST GAS RECIRCULATION CONTROL DEVICES

BACKGROUND OF THE INVENTION

This invention relates to control of the air/fuel ratio of an air/fuel mixture being supplied to an internal combustion engine, and more particularly to an electronic fuel injection control system which is adapted to correct the air/fuel ratio in dependence upon atmospheric pressure and intake pipe absolute pressure so as to maintain the air/fuel ratio at an optimum value during exhaust gas recirculating operation.

A fuel supply control system adapted for use with an internal combustion engine, particularly a gasoline engine has been proposed e.g. by U.S. Ser. No. 348,648, assigned to the same assignee as the present application, which is adapted to determine the valve opening period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

On the other hand, during operation of an engine at a high altitude, etc., it is generally carried out to correct the fuel supply quantity for the engine, in response to changes in the atmospheric pressure, so as to obtain an optimum air/fuel ratio best suited for the atmospheric pressure, for improvements in the fuel consumption, emission characteristics and driveability of the engine.

For instance, in a fuel supply control system adapted for correction of the basic valve opening period of a fuel injection valve by means of a correction coefficient as mentioned above, an atmospheric pressure-dependent correction coefficient is provided as one of the aforementioned correction coefficients, for correction of the air/fuel ratio of the mixture.

However, according to such conventional atmospheric pressure-dependent correction of the air/fuel ratio which is determined by intake pipe absolute pressure as noted above, the air/fuel ratio is corrected in dependence upon the atmospheric pressure alone. That is, the correction amount is not based upon the actual operating condition of the engine per se, making it difficult to perform the air/fuel ratio correction in a perfect manner.

On the other hand, in an engine which is provided with an exhaust gas recirculating device for improvement of the emission characteristics of the engine, absolute pressure in the exhaust gas recirculating passage at a location upstream of the exhaust gas recirculation valve, that is, back pressure in the exhaust pipe decreases with a decrease in the atmospheric pressure so that the exhaust gas recirculating rate decreases. As a consequence, the air/fuel ratio of the mixture becomes leaner. The degree of leaning of the air/fuel ratio is larger during exhaust gas recirculating operation than that when the exhaust gas recirculating operation is not effected.

OBJECT AND SUMMARY OF THE INVENTION

It is the object of the invention to provide an electronic fuel injection control system for an internal combustion engine, which is adapted to correct the air/fuel ratio of an air/fuel mixture being supplied to the engine during exhaust gas recirculating operation, in dependence upon not only atmospheric pressure but also intake pipe absolute pressure, so as to always control the air/fuel ratio to a desired value during exhaust gas recirculating operation, irrespective of changes in the atmospheric pressure, to thereby improve the fuel consumption, emission characteristics and driveability of the engine.

The present invention is based upon the recognitions that the quantity of air sucked into the engine cylinders is variable as a function of intake pipe absolute pressure as well as atmospheric pressure, and the atmospheric pressure-dependent air/fuel ratio correction can be made during exhaust gas recirculating operation, by a correcting amount corresponding to that applied for such correction when the exhaust gas recirculating operation is not effected, if the exhaust gas recirculating rate is maintained constant irrespective of changes in the atmospheric pressure.

The present invention provides an electronic fuel injection control system for use with an internal combustion engine, which comprises in combination: an exhaust gas recirculation passage communicating the exhaust pipe of the engine with the intake pipe of same at a location downstream of the throttle valve arranged therein; an exhaust gas recirculation valve arranged across the exhaust gas recirculation passage; means for controlling the valve opening of the exhaust gas recirculation valve so as to permanently maintain the ratio of a quantity of exhaust gases being recirculated through the exhaust gas recirculation passage to a quantity of intake air being supplied to the engine through the intake pipe, at a constant value; a sensor for detecting a value of engine rpm; a sensor for detecting a value of absolute pressure in the intake pipe of the engine; a sensor for detecting a value of ambient atmospheric absolute pressure; means for determining a basic valve opening period of at least one fuel injection valve as a function of values of engine rpm and intake pipe absolute pressure detected, respectively, by the engine rpm sensor and the intake pipe absolute pressure sensor, and generating a first signal indicative of the determined basic valve opening period; means for correcting the value of the first signal as a function of values of intake pipe absolute pressure and atmospheric absolute pressure detected, respectively, by the intake pipe absolute pressure sensor and the atmospheric absolute pressure sensor, and generating a second signal indicative of the corrected valve opening period; and means for driving the fuel injection valve to open same for a period of time corresponding to the value of the second signal.

The above and other objects, features and advantages of the invention will be more apparent from the ensuing detailed description taken in connection with the accompanying drawings:

BRIEF DESCRIPTION OF THE DRAWINGS

FIG. 9 is a block diagram illustrating the internal arrangement of the ECU, including a circuit for determining the value of an atmospheric pressure-dependent correction coefficient KPA;

FIG. 10 is a timing chart showing the relationship between a pulse signal So inputted to the sequential clock generator in FIG. 9 and clock pulses generated therefrom;

DETAILED DESCRIPTION

The present invention will now be described in detail with reference to the drawings.

Figure 1:
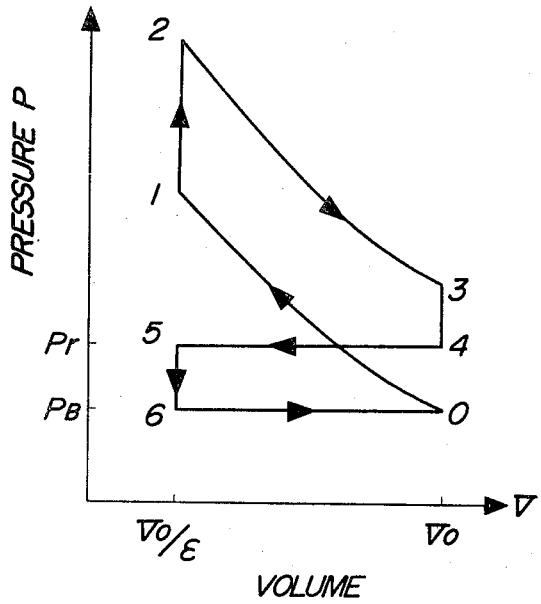
FIG. 1 is a pressure volume diagram of an Otto cycle engine.

FIG. 1 is a pressure volume diagram of an Otto cycle engine. 0→1 designates an adiabatic compression step, 1→2 an isochoric combustion step, 2→3 an adiabatic expansion step, and 3→4→5 an exhaust step, respectively. According to the diagram, when the exhaust valve is closed and simultaneously the intake valve is opened at state point 5, the pressure in the engine cylinder instantaneously drops from a value corresponding to exhaust pipe pressure Pr to a value corresponding to intake pipe pressure PB (step 5→6). In the diagram, 6→0 designates a suction step where the piston is moved from its top dead center to its bottom dead center.

It will now be explained how the suction gas amount Ga is determined during the step 5→6→0 where fresh air is sucked into the engine cylinder. In the explanation, let it be assumed that first, during the step 5→6 the residual gas in the engine cylinder is adiabatically expanded back into the intake pipe, while simultaneously reducing its own pressure from a value corresponding to pressure Pr to a value corresponding to pressure PB, and during the following step 6→0, the flowing-back residual gas and fresh air are sucked into the cylinder, while simultaneously exchanging heat with each other. Further, the heat exchange between the cylinder wall and the intake pipe wall, and the residual gas and fresh air is not taken into account in the assumption. Let it be also assumed as a second assumption that the residual gas and fresh air behave as ideal fluid and assume identical values with each other with respect to gas constant Ra, specific heat at constant pressure Cp, specific heat at constant volume Cv, and ratio of specific heat $\kappa$.

Figure 2:
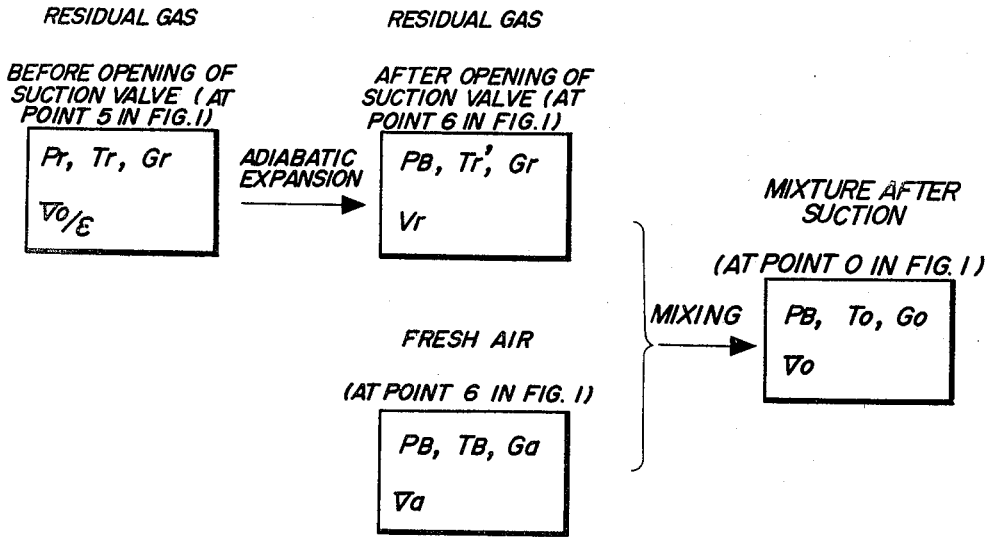
FIG. 2 is a view illustrating quantities of state of residual exhaust gas, fresh air, and a mixture thereof available, respectively, at state points 5, 6 and 0 in FIG. 1.

FIG. 2 shows the quantities of state of the residual gas, the fresh air and a mixture thereof, respectively, at state points 5, 6 and 0. The relationships between these quantities of state can be represented by the following equations. Symbols used in the equations are interpreted as follows:

P = pressure (Kg/cm$^2$abs.),
T = temperature (°K.),
G = quantity of air (Kg),
V = volume (m$^3$),
$\epsilon$ = compression ratio of the engine,
$\kappa$ = ratio of specific heat of air,
C = Vo/Ro, which is constant,
r, r′ = as of residual gas,
B = as in the intake pipe,
a = as of fresh air, and
o = as at state point 0 in FIG. 1

According to the above second assumption that all the gases have the same value Cv and to the principle of conservation of energy, $$Go \cdot Cv \cdot To = Gr \cdot Cv \cdot Tr' + Ga \cdot Cv \cdot TB \quad 1)$$

According to the equation of adiabatic change, $$Tr' = Tr(PB/Pr)^{(\kappa-1)/\kappa} \quad 2)$$

$$Vr = (Vo/\epsilon) \times (Pr/PB)^{1/\kappa} \quad 3)$$

According to the equation of state, $$Pr \cdot Vo/\epsilon = Gr \cdot Ra \cdot Tr \quad 4)$$

$$PB \cdot Vr = Gr \cdot Ra \cdot Tr' \quad 5)$$

$$PB \cdot Va = Ga \cdot Ra \cdot TB \quad 6)$$

$$PB \cdot Vo = Go \cdot Ra \cdot To \quad 7)$$

From the equations (1), (5) and (6), $$PB(Vr + Va) = Ra \cdot Go \cdot To \quad 8)$$

If the equation (7) is substituted into the equation (8), $$Vr + Va = Vo \quad 9)$$

The equation (9) shows that the mixture does not change in volume so long as its own pressure is constant.

If the equations (3) and (6) are applied to the equation (9), $$Ga = C \cdot PB/TB\{1 - (1/\epsilon)(Pr/PB)^{1/\kappa}\} \quad 10)$$

The equation (10) forms the basic principle of the present invention, showing that the quantity of suction air Ga is given as a function of intake pipe pressure PB, intake pipe temperature TB, and exhaust pipe pressure Pr.

In the event that there occurs a change in the back pressure or exhaust pipe pressure Pr at the step 3–4–5 in FIG. 1, in order to control the actual air/fuel ratio Ga/Gf (Gf=fuel quantity) to an air/fuel ratio Gao/Gfo at standard atmospheric pressure, that is, in order to satisfy the following equation:

$$Ga/Gf = Gao/Gfo \quad (11),$$

a quantity of fuel has to be supplied to the engine, which is determined by the following equation:

$$Gf = Gfo \times Ga/Gao = Gfo \times \frac{1-(1/\epsilon)(Pr/PB)^{1/\kappa}}{1-(1/\epsilon)(Pro/PB)^{1/\kappa}} \quad (12)$$

provided that TB remains constant.

Next, let us consider about the relationship between the back pressure Pr and the required fuel supply quantity, which is required for an engine during exhaust gas recirculation. Provided that the exhaust gas recirculation quantity is designated by GE, the quantity of fresh intake air Ga', and the total intake air quantity GT, $$GT = Ga' + GE \quad (13)$$

Although the equation (10) is based upon the assumption that fresh air alone is present in the intake pipe, theoretically the same equation can be satisfied even if the intake air in the intake pipe comprises a mixture of fresh air and exhaust gases returned from the exhaust pipe. That is, the total intake air quantity GT can be determined from the following equation:

$$GT = C(PB/TB)\{1-(1/\epsilon)(Pr/PB)^{1/\kappa}\} \quad (14)$$

It will be leaned from the equation (14) that the total intake air quantity GT increases with a decrease in the back pressure PR.

On the other hand, the exhaust gas recirculation quantity QE ($m^2$/sec) obtained can be represented as follows:

QE ∝ (the effective valve opening area A of the exhaust gas recirculation valve) × (the differential pressure ΔP between the exhaust gas recirculation valve)$^n$ provided that n is equal to ½–1. If the effective valve opening area A of the exhaust gas recirculation valve remains constant, $$QE \propto \Delta P^n = (Pr-PB)^n \quad (15)$$

When there occurs a drop in the atmospheric pressure, the back pressure Pr correspondingly decreases so that the value ΔP decreases with the decrease of the back pressure Pr, so long as the intake pipe absolute pressure PB remains constant. Accordingly, the exhaust gas recirculating quantity GE, which is expressed in terms of mass flow rate as equivalent to the quantity QE, also decreases. From the above, it will be learned that the exhaust gas recirculation rate XE ($=GE/(Ga+GE)=GE/GT$) decreases with a drop in the atmospheric pressure.

Figure 3:
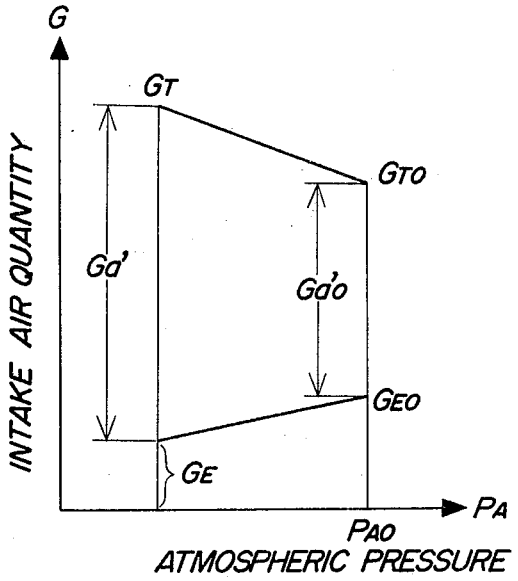
FIG. 3 is a graph showing the relationship between exhaust gas recirculating quantity, total intake air quantity and atmospheric pressure.

FIG. 3 endorses the above explanation, showing that the air/fuel ratio becomes lean to a larger extent when there occurs a drop in the atmospheric pressure during exhaust gas recirculating operation than when the exhaust gas recirculating operation is not effected. That is, the total intake air quantity GT increases when the atmospheric pressure PA drops below the standard atmospheric pressure PAo, irrespective of the exhaust gas recirculation quantity, in accordance with the equation (14). On the other hand, the exhaust gas recirculation quantity GE decreases with a decrease in the atmospheric pressure in accordance with the equation (15). Accordingly, the quantity of fresh intake air Ga' ($=GT-GE$) increases at a rate larger than the increase of the total intake air quantity GT. Also, the increase rate of the total intake air quantity GT becomes larger in proportion to the exhaust gas recirculation quantity GEo under the standard atmospheric pressure PAo. Therefore, it will be learned that the air/fuel ratio will become lean to a larger extent when the exhaust gas recirculating operation is carried out than when the same operation is interrupted, if no atmospheric pressure-dependent correction of the air/fuel ratio is carried out.

Figure 4:
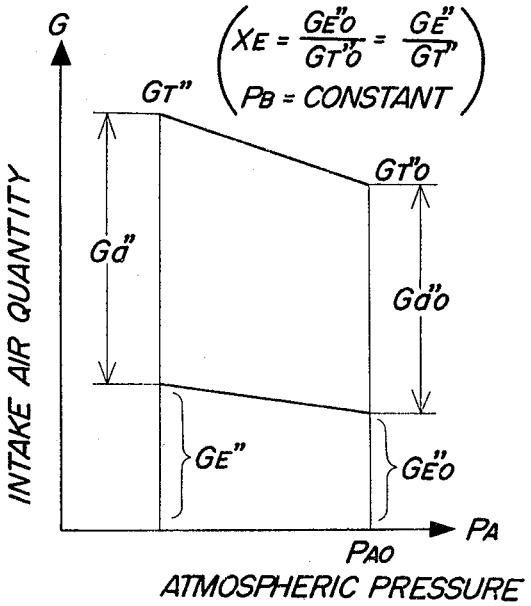
FIG. 4 is a graph showing the relationship between exhaust gas recirculating quantity, total intake air quantity and atmospheric pressure, which is required for maintaining the exhaust gas recirculating rate constant.

To control the exhaust gas recirculation quantity GE" so as to maintain the exhaust gas recirculation rate XE at a constant value independently of changes in the atmospheric pressure, as shown in FIG. 4, the following relationship must be fulfilled, as derived from the equation (14), provided that the values PB and TB remain constant:

$$GT = GTo \cdot \frac{1-(1/\epsilon)(Pr/PB)^{1/\kappa}}{1-(1/\epsilon)(Pro/PB)^{1/\kappa}} \quad (16)$$

If an air/fuel ratio obtained at the standard atmospheric pressure PAo, is designated by $\alpha_0$(=Ga"o/Gf"o, where Gf"o is a fuel quantity), and an air/fuel ratio at actual atmospheric pressure $\alpha$(=Ga"/Gf"), respectively, the following equation can be derived from the equations (13) and (16), and an equation of $XE=GE''o/GT''o=GE''/GT''$:

$$\alpha = \alpha_0 (Gf''o/Gf'') \cdot \frac{1-(1/\epsilon)(Pr/PB)^{1/\kappa}}{1-(1/\epsilon)(Pro/PB)^{1/\kappa}} \quad (17)$$

To make the air/fuel ratio $\alpha$ equal to the one $\alpha_0$, the following equation must be fulfilled:

$$Gf'' = Gf''o \cdot \frac{1-(1/\epsilon)(Pr/PB)^{1/\kappa}}{1-(1/\epsilon)(Pro/PB)^{1/\kappa}} \quad (18)$$

In an internal combustion engine which does not include an element requiring high exhaust pressure, such as a turbocharger, the difference between the pressure Pr and the pressure PA is ignorably small, as compared with the difference between the pressure Pr and the intake pipe pressure PB. Therefore, from the equation (18), the following equations can be reached:

$$Gf'' = KPA \times Gf''o \quad (19)$$

$$KPA = \frac{1-(1/\epsilon)(PA/PB)^{1/\kappa}}{1-(1/\epsilon)(PAo/PB)^{1/\kappa}} \quad (20)$$

where PA designates actual atmospheric pressure (absolute pressure), PAo standard atmospheric pressure, and KPA an atmospheric pressure-dependent correction coefficient, hereinlater referred to, respectively.

To obtain a desired air/fuel ratio, a fuel quantity Gf" given by the equation (19) has only to be supplied to the engine. That is, so long as the exhaust gas recirculation quantity GE is controlled so as to keep the exhaust gas recirculation rate XE constant irrespective of changes in the atmospheric pressure, during exhaust gas recirculation the air/fuel ratio can be corrected by the use of the correction coefficient KPA obtained by the equation (20) which is the same as that applicable when the exhaust gas recirculation is not effected, as will be understood by comparing between the two equations (12) and (18).

As noted above, the atmospheric pressure-dependent correction coefficient KPA can be determined as a function of actual atmospheric pressure PA and actual intake pipe absolute pressure PB on condition that the exhaust gas recirculation rate XE remains constant, irrespective of whether or not the exhaust gas recirculation is effected, though the coefficient value KPA basically depends upon the compression ratio of the engine.

Embodiments of the invention for atmospheric pressure-dependent air/fuel ratio correction by means of the correction coefficient KPA will now be described with reference to FIGS. 5 through 13.

Figure 5:
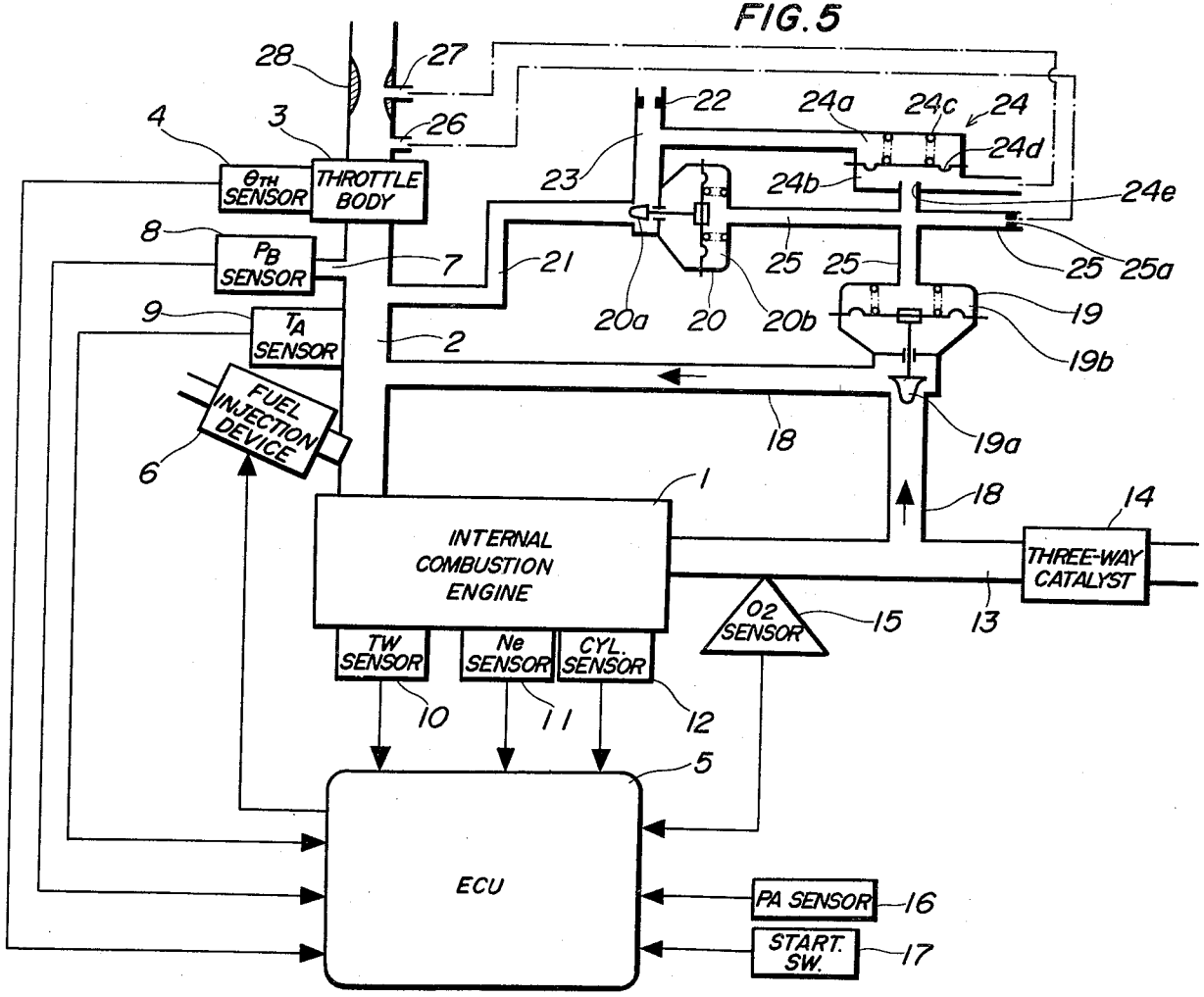
FIG. 5 is a block diagram illustrating the arrangement of a fuel injection control system according to the present invention.

Referring first to FIG. 5, there is illustrated the whole arrangement of a fuel injection control system for internal combustion engines, to which the present invention is applied. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, all formed by electromagnetically operated fuel injection valves, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The fuel injection device 6 is connected to a fuel pump, not shown. The main injectors and the subinjector are electrically connected to the ECU 5 in a manner having their valve opening periods or fuel injection quantities controlled by driving signals supplied from the ECU 5.

On the other hand, an absolute pressure sensor 8 communicates through a conduit 7 with the interior of the main intake pipe at a location immediately downstream of the main throttle valve of the throttle body 3. The absolute pressure sensor 8 is adapted to detect absolute pressure in the intake pipe 2 and applied an electrical signal indicative of detected absolute pressure to the ECU 5. An intake air temperature sensor 9 is arranged in the intake pipe 2 at a location downstream of the absolute pressure sensor 8 and also electrically connected to the ECU 5 for supplying thereto an electrical signal indicative of detected intake air temperature.

An engine water temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., a pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starting switch 17 of the engine, respectively, for supplying an electrical signal indicative of detected atmospheric pressure and an electrical signal indicative of its own on and off positions to the ECU 5.

An exhaust gas recirculation passage 18 is connected between a portion of the exhaust pipe 13 upstream of the three-way catalyst 14 and a portion of the intake pipe 2 downstream of the throttle body 3, and is adapted to be closed by a vacuum responsive type exhaust gas recirculation control valve 19 arranged thereacross. An atmospheric pressure passage 21 opens at its one end in the intake pipe 2 at a location downstream of the throttle body 3 and communicates at its other end with the atmosphere, with a vacuum responsive type control valve 20 arranged thereacross to be closed thereby. A vacuum chamber 23 is defined in the passage 21 in the vicinity of the above other end, by an orifice 22 provided in the same other end, which communicates with a regulating valve 24. The regulating valve 24 comprises a first chamber **24*a* communicating with the vacuum chamber 23, a second chamber 24*b* communicating through a passage 25 with the working chambers 19*b* and 20*b* of the exhaust gas recirculation control valve 19 and the control valve 20, a diaphragm 24*d* partitioning the first chamber 24*a* and the second chamber 24*b*, and a spring 24*c* urging the diaphragm 24*d* toward a valve bore 24*e* for closing same. The above passage 25 communicates the working chambers 19*b* and 20*b* of the control valves 19 and 20 with the second chamber 24*b* of the regulating valve 24 and also communicates with a first vacuum outlet 26 opening in the intake pipe 2 at a location immediately upstream of the throttle body 3, through an orifice 25*a*. The second chamber 24*b* of the regulating valve 24 communicates with a second vacuum outlet 27 opening in a venturi 28 located upstream of the first vacuum outlet 26** or in its vicinity.

When the engine is operated, an operating negative pressure Pc generated in the intake pipe 2 at the first vacuum outlet 26 is delivered through the passage 25 toward the working chambers 19*b* and 20*b* of the control valves 19 and 20. On the other hand, a venturi negative pressure Pv generated in the venturi 28 at the first vacuum outlet 27 is introduced into the second chamber 24*b* of the regulating valve 24 to act upon the diaphragm 24*d* to cause it to be displaced to close the valve bore 24*e*. When this venturi negative pressure Pv is not so large as to cause the diaphragm 24*d* to close the valve bore 24*e*, the operating negative pressure Pc, which is larger than the venturi negative pressure Pv does not effectively act upon the diaphragms of the control valves 19 and 20 to open the valves, due to the presence of the orifice 25*a* in the passage 25. When the venturi negative pressure Pv increases to cause the diaphragm 24*d* of the regulating valve 24 to close the valve bore 24*e*, the operating negative pressure Pc actually effectively acts upon the control valves 19 and 20 to open them. Thus, recirculation of exhaust gases from the exhaust pipe 13 to the intake pipe 2 is effected.

On this occasion, the control valve 20 opens the passage 21 to establish communication between the intake pipe 2 downstream of the throttle valve and the vacuum chamber 23. The resulting negative pressure generated in the chamber 23, which is slightly large in absolute pressure than the intake pipe absolute pressure, acts upon the first chamber 24*a* of the regulating valve 24 to cause displacement of the diaphragm 24*d* away from the valve bore 24*e* to open the bore 24*e*. In this manner, the regulating valve 24 is regulated to open or close by means of negative pressure in the vacuum chamber 23 and the venturi negative pressure Pv.

When the flow rate of intake air through the venturi 28 increases, the venturi negative pressure Pv correspondingly increases so that the valve bore 24*e* is closed. Consequently, the operating negative pressure acting upon the working chambers 19*b* and 20*b* of the control valves 19 and 20 increase, resulting in an increased flow rate of exhaust gas recirculation.

When there occurs a drop in the atmospheric pressure, there occurs a corresponding rise in the venturi negative pressure Pv at the second vacuum outlet 27, even when the intake pipe absolute pressure PB remains constant. As a consequence, the valve lift of the exhaust gas recirculation valve 19 is increased to increase the flow rate of exhaust gas recirculation, in the same manner as described above.

Thus, the exhaust gas recirculation control system including the valves 19, 20 and 24 can operate to maintain the ratio of the recirculating quantity of exhaust gases to the total intake air quantity at a substantially constant value, even when there occurs a change in the atmospheric pressure.

Figure 6:
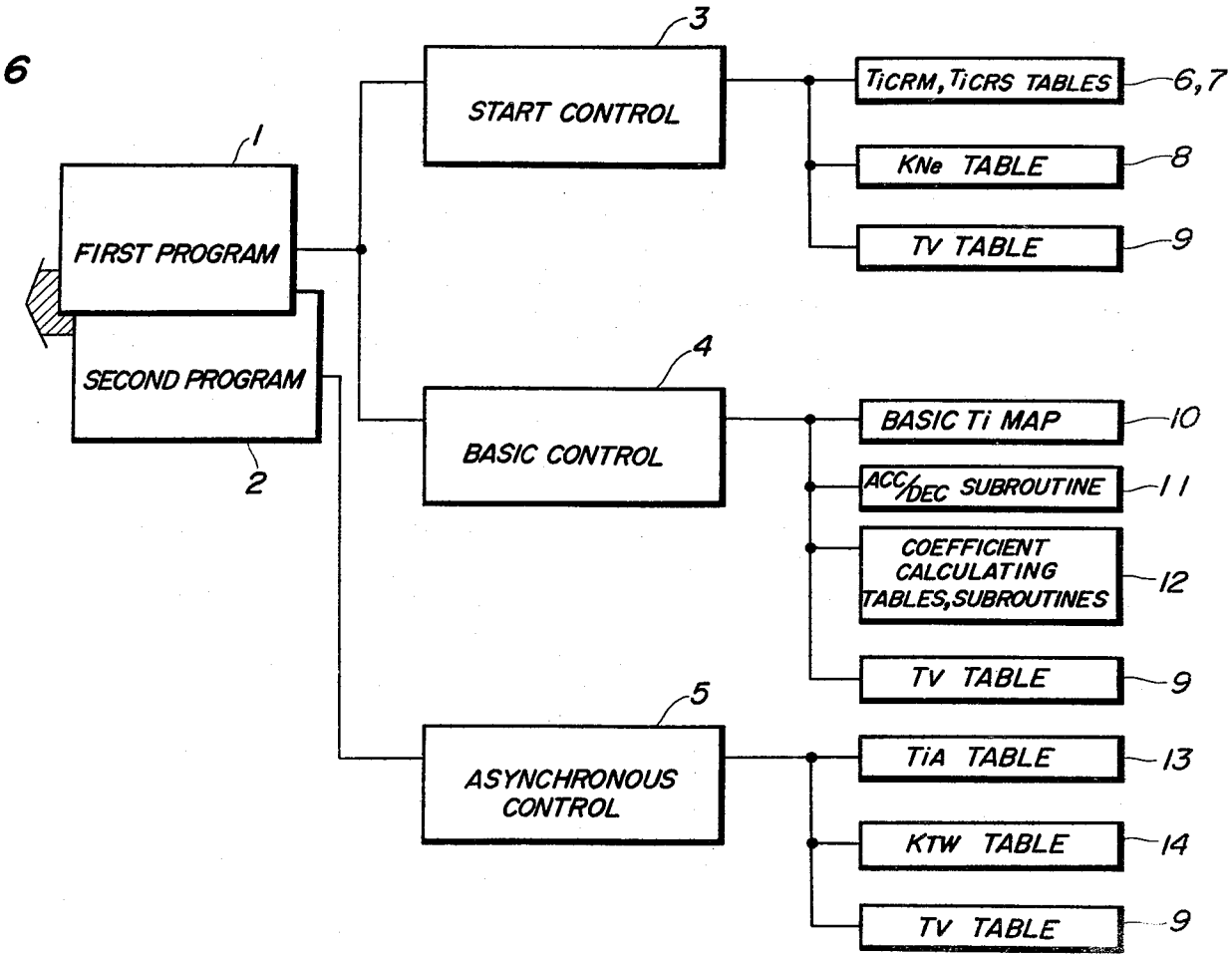
FIG. 6 is a block diagram illustrating a whole program for control of the valve opening periods TOUTM and TOUTS of the main injectors and the subinjector, which is incorporated in the electronic control unit (ECU) in FIG. 5.

FIG. 6 shows a block diagram showing the whole program for air/fuel ratio control, i.e., control of the valve opening periods TOUTM and TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (21)$$

$$TOUTS = TiCRS \times KNe + TV \quad (22)$$

where TiCRM and TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery 18, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC) + (TV + \Delta TV) \quad (23)$$

$$TOUTS = (TiS - TDEC) \times (KTA \times KTW \times KAST \times KPA) + TV \quad (24)$$

where TiM and TiS represent basic values of the valve opening periods for the main injectors and the subinjector, respectively, and are determined from a basic Ti map 10, and TDEC and TACC represent constants applicable, respectively, at engine decceleration and at engine acceleration and are determined by acceleration and decceleration subroutines 11. The coefficients KTA, KTW, etc. are determined by their respective tables and/or subroutines 12. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture. TACC is a fuel increasing constant applicable at engine acceleration and determined by a subroutine and from a table.

On the other hand, the valve opening period TMA for the main injectors which is applicable in asynchronism with the TDC signal is determined by the following equation:

$$TMA = TiA \times KTWT \times KAST + (TV + \Delta TV) \quad (25)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 7:
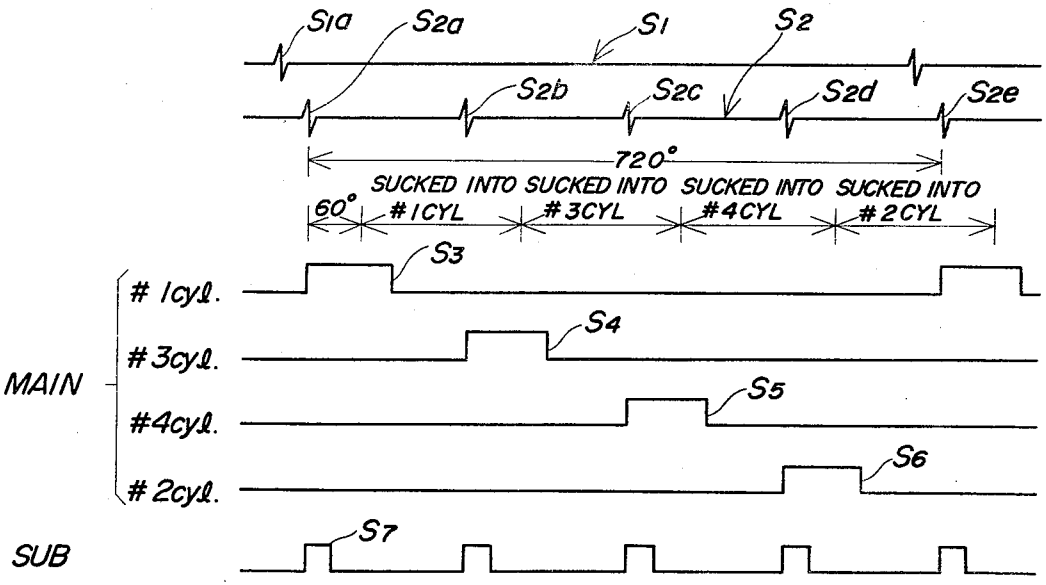
FIG. 7 is a timing chart showing the relationship between a cylinder-discriminating signal and a TDC signal inputted to the ECU, and driving signals for the main injectors and the subinjector, outputted from the ECU.
Figure 8:
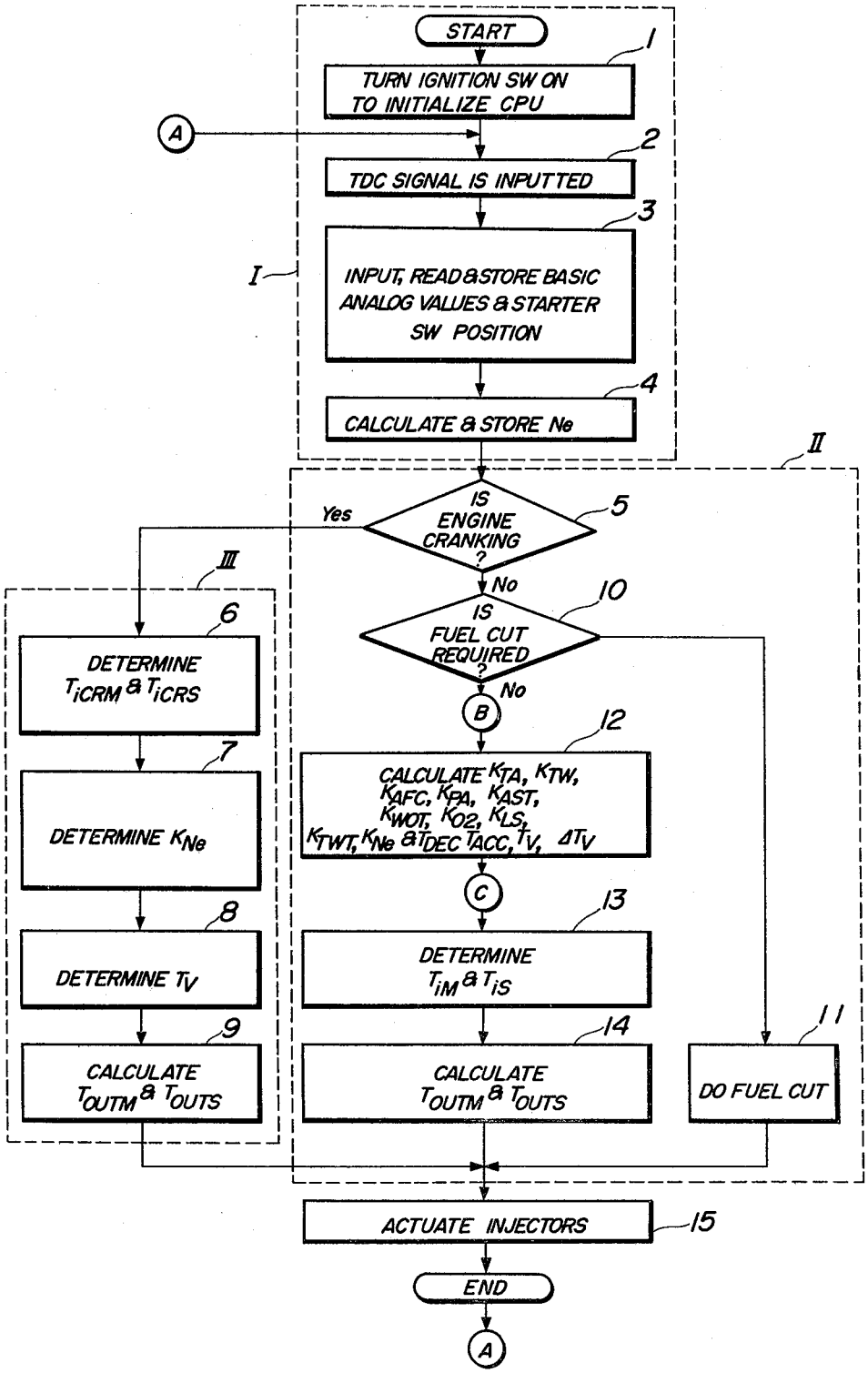
FIG. 8 is a flow chart showing a main program for control of the valve opening periods TOUTM and TOUTS.

FIG. 7 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1$ a each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injector of the first engine cylinder, concurrently with the first TDC signal pulse $S_2a$, the driving signal $S_4$ for the third engine cylinder concurrently with the second TDC signal pulse $S_2b$, the driving signal $S_5$ for the fourth cylinder concurrently with the third pulse $S_2c$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Referring next to FIG. 7, there is shown a flow chart of the aforementioned first program 1 for control of the valve opening period in synchronism with the TDC signal in the ECU 5. The whole program comprises an input signal processing block I, a basic control block II and a start control block III. First in the input processing block I, when the ignition switch of the engine is turned on, a CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle valve opening $\theta$th, battery voltage V, output voltage value V of the $O_2$ sensor and on-off state of the starting switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aforementioned equations (21), (22) to calculate the values of TOUTM and TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction constants TDEC, TACC, TV and $\Delta$TV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM and TOUTS on the basis of the values of correction coefficients, correction constants and basic valve opening periods determined at the steps 12 and 13, as described above, using the aforementioned equations (23), (24) (step 14). The main injectors and the subinjector are actuated with valve opening periods corresponding to the values of TOUTM and TOUTS obtained by the aforementioned steps 9, 11 and 14 (step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

FIGS. 9 through 13 illustrate the internal construction of the ECU 5 by way of example, including means for determining the air/fuel ratio correction coefficient KPA, referred to above. Referring first to FIG. 9, there is illustrated a whole circuit arrangement provided in the ECU 5, including a circuit for arithmetically calculating the value of the correction coefficient KPA. The intake pipe absolute pressure PB sensor 8, the engine cooling water temperature TW sensor 10, the intake air temperature TA sensor 9, and the atmospheric pressure PA sensor 16, all appearing in FIG. 5, are connected, respectively, to a PB value register 30, a TW value register 31, a TA value register 32, and a PA value register 33, by way of a group of A/D converters 29. The PB value register 30 has its output connected to a basic Ti value calculating circuit 34 and also to a KPA value determining circuit 35. The TW value register 31 and the TA value register 32 have their respective outputs connected to the basic Ti value calculating circuit 34. The PA value register 33 has its output connected to the KPA value determining circuit 35. The engine rpm Ne sensor 11 in FIG. 5 is connected to a sequential clock generator 37, by way of a one shot circuit 36, which generator 37 in turn has several output terminals connected to respective ones of an NE value counter 38, an NE value register 39, the above KPA value calculating circuit 35, a multiplier 40, and a Ti value register 41. The NE value counter 38 is connected to a reference clock generator 42 to be supplied with clock pulses therefrom. The clock generator 42, the NE value counter 38, and the NE value register 39 are serially connected in the mentioned order, the NE value register 39 being connected at its output to the basic Ti value calculating circuit 34. The basic Ti value calculating circuit 34 has its output connected to the multiplier 40 at its one input terminal 40*a*, and the KPA value determining circuit 35 to the same circuit 40 at its other input terminal 40*b*, respectively. The multiplier 40 has its output terminal 40*c* connected to a Ti value control circuit 43 through the aforementioned Ti value register 41, which circuit 43 in turn has its output connected to the main injectors or subinjector 6*a* of the fuel injection device 6 in FIG. 5.

An output or TDC signal of the engine rpm Ne sensor 11 is supplied to the one shot circuit 36 which forms a shaping circuit in cooperation with its adjacent sequential clock generator 37. Upon application of each pulse of the TDC signal to the one shot circuit 36, it generates an output pulse So and applies same to the sequential clock generator 37 to cause it to generate clock pulses CP0–CP11 in a sequential manner. FIG. 10 shows the manner in which the clock pulses CP0–CP11 are sequentially generated each time a pulse So is applied to the circuit 37. The clock pulse CP0 is applied to the NE value register 39 to cause same to store an immediately preceding count outputted from the NE value counter 38 which permanently counts reference clock pulses generated by the reference clock generator 42. Then, the clock pulse CP1 is applied to the NE value counter 38 to reset the immediately preceding count in the counter 38 to zero. Therefore, the engine rpm Ne is measured in the form of the number of reference clock pulses counted between two adjacent pulses of the TDC signal. The counted reference clock pulse number or measured engine rpm NE is loaded into the above NE value register 39. On the other hand, the clock pulses CP0–CP9 are supplied to the KPA value determining circuit 35, the clock pulse CP10 to the multiplier 40, and the last clock pulse CP11 to the Ti value register 41, respectively.

In a manner parallel with the above operation, output signals of the intake pipe absolute pressure PB sensor 8, the engine cooling water temperature TW sensor 10, the intake-air temperature TA sensor 9, and the atmospheric pressure PA sensor 16 are supplied to the A/D converter group 29 to be converted into respective corresponding digital signals which are in turn loaded into the PB value register 30, the TW value register 31, the TA value register 32, and the PA value register 33, respectively. These values stored in the registers are then supplied to the basic Ti value calculating circuit 34, which in turn performs arithmetic calculation of the basic valve opening period Ti (TOUTM or TOUTS) for the fuel injection valve(s) 6*a* in accordance with the manner previously described with reference to FIGS. 6 through 8, on the basis of the input data PB, TW, TA and NE supplied from the registers 30, 31, 32 and 39. The calculated Ti value is supplied to the input terminal 40*a* of the multiplier 40 as an input A.

The KPA value determining circuit 35 determines the value of the atmospheric pressure-dependent correction coefficient KPA by arithmetic calculation, for instance, in a manner based upon the aforementioned equation (20), on the basis of input data PB and PA supplied from the PB value register 30 and the PA value register 33. A manner of calculation by the circuit 35 will be hereinlater described in detail with reference to FIGS. 11 and 12. The resultant determined value of correction coefficient KPA is supplied to the other input terminal 40*b* of the multiplier 40 as an input B.

In the multiplier 40, multiplication of the value of the input A or the basic Ti value by the value of the input B or the correction coefficient KPA is carried out in synchronism with inputting of each clock pulse CP10 thereto from the sequential clock generator 37. The resultant calculated value or Ti value compensated for atmospheric pressure PA and intake pipe absolute pressure PB is outputted from the multiplier 40 through its output terminal 40*c* and loaded into the Ti value register 41. The Ti value register 41 stores the compensated Ti value upon application of each clock pulse CP11 thereto from the sequential generator 37, and applies same to the Ti value control circuit 43. The circuit 43 in turn operates upon the input Ti value data to supply a driving signal to each fuel injection valve 6*a* to open same for a valve opening period corresponding to the input Ti value.

Figure 11:
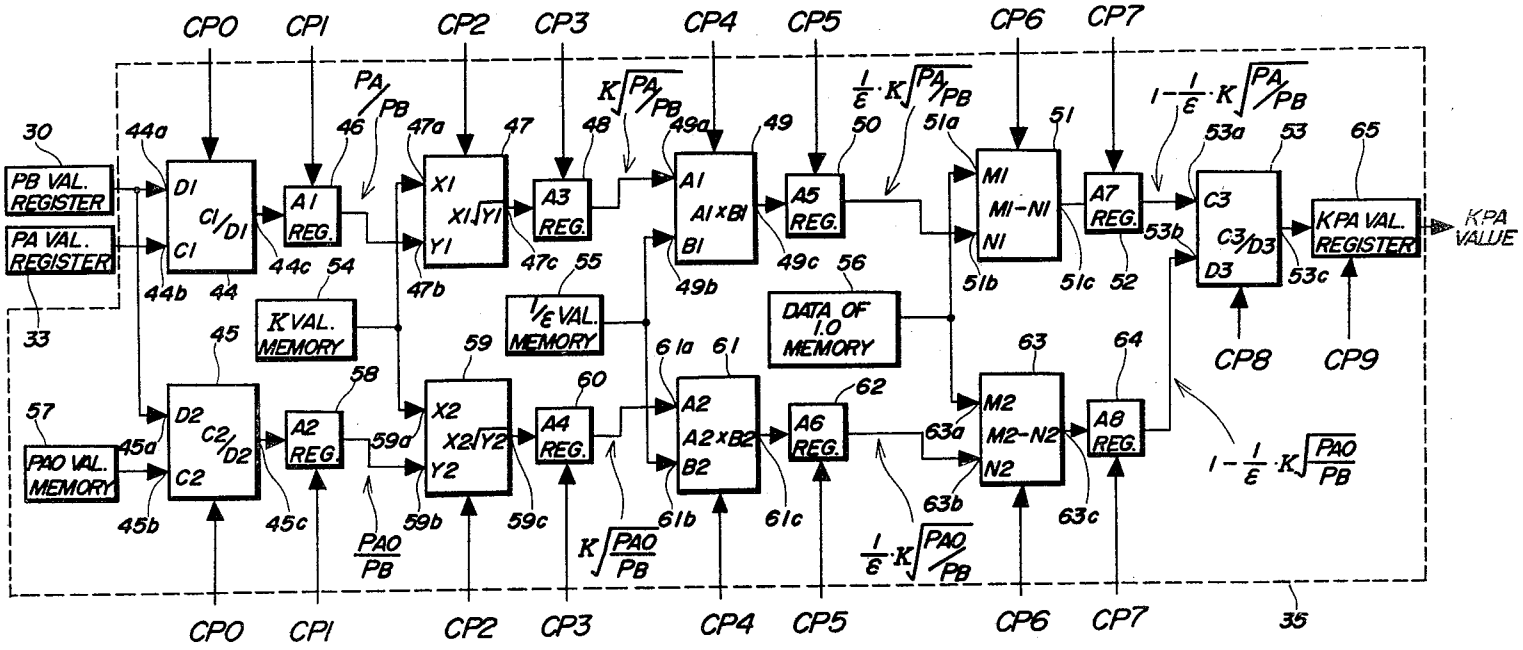
FIG. 11 is a block diagram illustrating the internal arrangement of the coefficient KPA value determining circuit in FIG. 9.

FIG. 11 illustrates details of the internal construction of the KPA value determining circuit 35 in FIG. 9, where arithmetic calculation of the correction coefficient KPA is carried out in a manner based upon the aforementioned equation (20). The PB value register 30 in FIG. 9 has its output connected to a divider 44 at its one input terminal 44*a*, as well as to another divider 45 at its one input terminal 45*a*. The PA value register 33 in FIG. 9 has its output connected to the divider 44 at its other input terminal 44*b*. The divider 44 has its output terminal 44*c* connected to a root calculating circuit 47 at its one input terminal 47*b* by way of an A1 register 46, which in turn has its output terminal 47*c* connected to a multiplier 49 at its one input terminal 49*a*, by way of an A3 register 48. The multiplier 49 has its output terminal 49*c* connected to a subtracter 51 at its one input terminal 51*b* by way of an A5 register 50, which in turn has its output terminal 51*c* connected to a divider 53 at its one input terminal 53*a*, through an A7 register 52. The divider 53 has its output terminal 53*c* connected to the input terminal 40*b* of the multiplier 40 in FIG. 9 by way of a KPA value register 65. The aforementioned divider 45 has its output terminal 45*c* connected to a root calculating circuit 59 at its one input terminal 59*b* through an A2 register 58, which in turn has its output terminal 59*c* connected to a multiplier 61 at its one input terminal 61*a* through an A4 register 60. The multiplier 61 has its output terminal 61*c* connected to a subtracter 63 at its one input terminal 63*b*, which has its output terminal 63*c* connected to the other input terminal 53*b* of the divider 53, through an A8 register 64. A PAo value memory 57 is connected to the other input terminal 45*b* of the divider 45. A K value memory 54 is connected to the other input terminals 47*a* and 59*a* of the root calculating circuits 47 and 59. A $1/\epsilon$ value memory 55 is connected to the other input terminals of the multipliers 49 and 61, and a 1.0 value memory 56 is connected to the other input terminals 51*a* and 63*a* of the subtracters 51 and 63.

The KPA value determining circuit 35 constructed above operates as follows: The divider 44 has its input terminal 44*a* supplied with PB value data from the PB value register 30 in FIG. 9 as an input D1, and its other input terminal 44*b* with PA value data from the PA value register 33 in FIG. 9 as an input C1, respectively. The divider 44 supplies a quotient of C1/D1 or PA/PB obtained by dividing the value of the input C1 by the value of the input D1, to the A1 register 46, upon application of each clock pulse CP0 to the circuit 44. The A1 register 46 in turn replaces its old stored value by the new value C1/D1 each time a clock pulse CP1 is applied thereto, and supplies its newly stored value to the input terminal 47*b* of the root calculating circuit 47, as an input Y1. The root calculating circuit 47 has its other input terminal 47*a* supplied with a value of ratio of specific heat $\kappa$ of air from the K value memory 54, as an input X. The root calculating circuit 47 calculates the X1th root of Y1, i.e. $\kappa\sqrt{PA/PB}$, upon application of each clock pulse CP2 thereto, and applies same to the A3 register 48 through its output terminal 47*c*. Upon application of each clock pulse CP3 to the A3 register 48, it replaces its old stored value by the new value of $\kappa\sqrt{PA/PB}$ and applies same to the input terminal 49*a* of the multiplier 49, as an input A1. The multiplier 49 has its other input terminal 49*b* supplied with a value of $1/\epsilon$ from the $1/\epsilon$ value memory 55, an input B1, so that multiplication of the input A1 by the input B1 is carried out upon application of each clock pulse CP4 to the multiplier 49. The resultant product A1×B1, i.e. $1/\epsilon\cdot\kappa\sqrt{PA/PB}$ is supplied to the A5 register 50, through its output terminal 49*c*. Upon application of each clock pulse CP5 to the A5 register 50, it replaces its old stored value by the new value of the product A1×B1, and supplies same to the subtracter 51 at its input terminal 51*b*, as an input N1. The subtracter 51 has its other input terminal 51*a* supplied with a value of 1.0 from the 1.0 value memory 56, as an input M1, so that subtraction of N1 from M1 is calculated, upon application of each clock pulse CP6 to the subtracter 51. The resultant difference or $1-1/\epsilon\cdot\kappa\sqrt{PA/PB}$ is applied to the A7 register 52, through the output terminal 51*c* of the subtracter 51. The A7 register 52 has its old stored value replaced by the new value of the above difference M1−N1, upon application of each clock pulse CP7 thereto, and supplies same to the divider 53 at its input terminal 53*a*, as an input C3.

On the other hand, similar calculations to those described above are carried out also in the divider 45, the root calculating circuit 59, the multiplier 61, and the subtracter 63. For instance, at the divider 45, a quotient of PAo/PB is calculated on the basis of a standard atmospheric pressure value PAo supplied from the PAo value memory as an input C2, and an actual intake pipe absolute pressure value PB supplied from the PB value register 30, as an input D2. Further, a root value of $\kappa\sqrt{PAo/PB}$ is calculated at the root calculating circuit 59, a product of $1/\epsilon\cdot\kappa\sqrt{PAo/PB}$ at the multiplier 61, and a difference of $1-1/\epsilon\cdot\kappa\sqrt{PAo/PB}$ at the subtracter 63, respectively, in manners similar to those described above. Finally, the divider 53 has its input terminal 53*b* supplied with the resultant difference of $1-1/\epsilon\cdot\kappa\sqrt{PAo/PB}$, as an input D3. At the divider 53, division of the input C3 by the input D3 is carried out to obtain a quotient of C3/D3, that is, $$KPA = \frac{1-(1/\epsilon)(PA/PB)^{1/\kappa}}{1-(1/\epsilon)(PAo/PB)^{1/\kappa}}$$

The above quotient is outputted from the divider 53 through its output terminal 53*c* and applied to the KPA value register 65. The KPA value register 65 has its old stored value replaced by the new value of C3/D3 or KPA upon application of each clock pulse CP9 thereto, and applies its new stored value to the input terminal 40*b* of the multiplier 40 in FIG. 9.

Figures 12, 13:
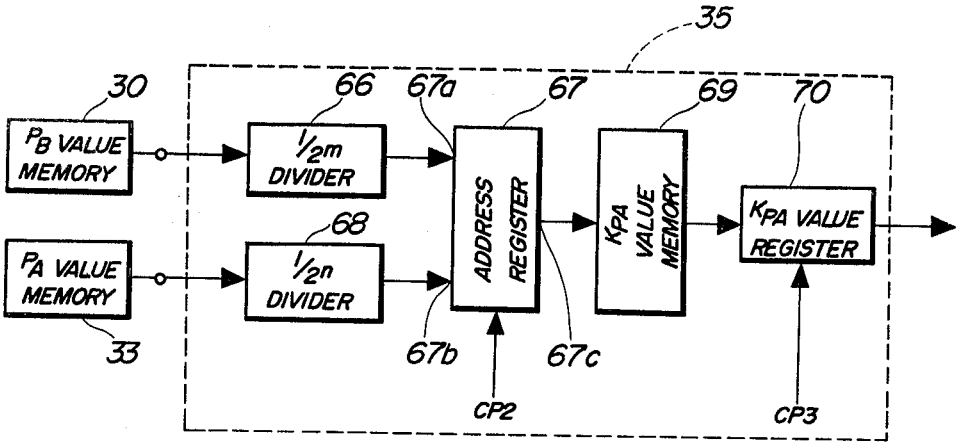
FIG. 12 is a block diagram illustrating another embodiment of the correction coefficient KPA value determining circuit.
FIG. 13 is a view showing an atmospheric pressure-intake pipe absolute pressure map for determining the value of the correction coefficient KPA.

FIG. 12 illustrates another embodiment of the KPA value determining circuit 35 in FIG. 9. According to this embodiment, a correction coefficient KPA value is read from a plurality of predetermined values which are previously determined by using the aforegiven equation (20) and stored, in accordance with detected values of atmospheric pressure PA and intake pipe absolute pressure PB. The PB value register 30 in FIG. 9 has its output connected to an address register 67 at its first input terminal 67*a*, by way of a $\frac{1}{2}^m$ divider 66. The PA value register 33 has its output connected to the same address register 67 at its second input terminal 67*b* by way of a $\frac{1}{2}^n$ divider 68. The address register 67 has its output terminal 67*c* connected to the input of a KPA value data memory 69 which in turn has its output connected to the input of a KPA value register 70. This KPA value register 70 has its output connected to the input terminal 40*b* of the multiplier 40 in FIG. 9.

FIG. 13 illustrates a map for determining the value of correction coefficient KPA in accordance with atmospheric pressure PA and intake pipe absolute pressure PB. The KPA values in the map are previously calculated by the equation (20). Although in the FIG. 13 example, the PA value and the PB value are each comprised of eight predetermined values, they may each be comprised of another number of such predetermined values. When the actual value PA or PB lies between adjacent ones of the predetermined PA or PB values, the KPA value may be determined by means of an interpolation method, to avoid use of a large capacity memory.

A plurality of addresses are stored in the address register 67 in FIG. 12, which correspond to the predetermined values of atmospheric pressure PA and intake pipe absolute pressure PB in the map of FIG. 13, while predetermined values KPAij of correction coefficient KPA are stored in the KPA value data memory 69, which correspond to the above addresses in the register 67.

An output of the PB value register 30 in FIG. 9 is supplied to the $\frac{1}{2}^m$ divider 66 in FIG. 12 to be converted into a corresponding integral number, and then loaded into the address register 67 through its first input terminal 67*a*. On the other hand, an output of the PA value register 33 is supplied to the $\frac{1}{2}^n$ divider 68 to be converted into a corresponding integral number and loaded into the address register 67 through its second input terminal 67*b*. An address corresponding to the loaded values PA and PB is selectively read from the register 67 upon application of each clock pulse CP2 thereto, and supplied to the KPA value data memory 69. At the KPA value memory 69, a value of the correction coefficient KPA is selectively read, which corresponds to the input address, and then loaded into the KPA value register 70. The latter replaces its old stored value by the new KPA value inputted thereto, upon application of each clock pulse CP3 thereto, and the new KPA value is supplied to the input terminal 40*b* of the multiplier 40 in FIG. 9.

What is claimed is:

1. In an electronic fuel injection control system for use with an internal combustion engine of the type having an intake pipe, an exhaust pipe, a throttle valve arranged in said intake pipe, and at least one fuel injection valve disposed to inject fuel being supplied to said engine, a valve opening period of which determines a fuel injection quantity thereof, the combination comprising: an exhaust gas recirculation passage communicating the exhaust pipe of the engine with the intake pipe thereof at a location downstream of said throttle valve; an exhaust gas recirculation valve arranged across said exhaust gas recirculation passage; means for controlling the valve opening of said exhaust gas recirculation valve so as to maintain the ratio of a quantity of exhaust gases being recirculated through said exhaust gas recirculation passage to a total quantity of intake air being supplied to the engine through the intake pipe, at a constant value; a sensor for detecting a value of engine rpm; a sensor for detecting a value of absolute pressure in the intake pipe of the engine; a sensor for detecting a value of ambient atmospheric absolute pressure; means for determining a basic valve opening period of said fuel injection valve as a function of values of engine rpm and intake pipe absolute pressure detected, respectively, by said engine rpm sensor and said intake pipe absolute pressure sensor, and generating a first signal indicative of the determined basic valve opening period; means for correcting the value of said first signal as a function of values of intake pipe absolute pressure and atmospheric absolute pressure detected, respectively, by said intake pipe absolute pressure sensor and said atmospheric absolute pressure sensor, and generating a second signal indicative of the corrected valve opening period; and means for driving said fuel injection valve to open same for a period of time corresponding to the value of said second signal.

2. The electronic fuel injection control system as claimed in claim 1, wherein said correcting means comprises: means for calculating a value of atmospheric pressure-dependent correction coefficient by means of an equation given below, and means for multiplying the value of said first signal by the calculated value of said atmospheric pressure-dependent correction coefficient:

$$KPA = \frac{1 - (1/\epsilon)(PA/PB)^{1/\kappa}}{1 - (1/\epsilon)(PAo/PB)^{1/\kappa}}$$

where $\epsilon$ represents the compression ratio of the engine, PA the atmospheric absolute pressure, PAo the standard atmospheric absolute pressure, PB the intake pipe absolute pressure, and $\kappa$ the ratio of specific heat of air, respectively.

3. The electronic fuel injection control system as claimed in claim 1, wherein said intake pipe of the engine includes a venturi portion, and said valve opening controlling means comprises an air passage connecting a portion of said intake pipe at a location downstream of said throttle valve to atmosphere, a control valve arranged in said air passage, said exhaust gas recirculation valve and said control valve each having a vacuum responsive actuator, and a regulating valve for controlling vacuum intensity in the actuator for each of said exhaust gas recirculation valve and said control valve, said regulating valve being responsive to differential vacuum pressure between vacuum pressure in said venturi portion and vacuum pressure in said intake pipe at a location downstream of said throttle valve.

* * * * *